US006779982B2

(12) United States Patent
Heo

(10) Patent No.: US 6,779,982 B2
(45) Date of Patent: Aug. 24, 2004

(54) APPARATUS FOR CONTROLLING DRIVING OF RECIPROCATING COMPRESSOR AND METHOD THEREOF

(75) Inventor: Kyung-Bum Heo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/279,122

(22) Filed: Oct. 24, 2002

(65) Prior Publication Data

US 2003/0133807 A1 Jul. 17, 2003

(30) Foreign Application Priority Data

Jan. 14, 2002 (KR) ..... 2002-2060

(51) Int. Cl.[7] ..... F04B 49/06

(52) U.S. Cl. ..... 417/44.11; 417/44.1; 417/45; 417/53; 417/212; 417/417; 62/6

(58) Field of Search ..... 417/44.11, 44.1, 417/45, 53, 18, 212, 417; 62/6, 228.5

(56) References Cited

U.S. PATENT DOCUMENTS 5,032,772 A * 7/1991 Gully et al. ..... 318/135
5,809,792 A * 9/1998 Song ..... 62/115
5,867,996 A * 2/1999 Takano et al. ..... 62/175
6,174,136 B1 * 1/2001 Kilayko et al. ..... 417/44.1
6,176,683 B1 * 1/2001 Yang ..... 417/44.1
6,208,497 B1 * 3/2001 Seale et al. ..... 361/160
6,289,680 B1 * 9/2001 Oh et al. ..... 62/6

* cited by examiner

*Primary Examiner*—Justine Yu
*Assistant Examiner*—Michael K. Gray
(74) *Attorney, Agent, or Firm*—Birch, Stewart, Kolasch & Birch, LLP

(57) ABSTRACT

Disclosed is an apparatus for controlling a driving of a reciprocating compressor and a method thereof, in which a cooling capacity is decreased without a re-expansion loss by controlling a driving of a compressor used in a refrigerator by using a current offset when the cooling capacity of a refrigerator is varied. To this end, in the compressor which controls the cooling capacity by varying an inner stroke according to a stroke reference value set by a user, the apparatus comprises a storage unit for storing a current offset value corresponding to a cooling capacity variable amount; an adding unit for adding the current offset value to a current value applied to the compressor in accordance with that the cooling capacity is varied by a user; a microcomputer for generating a switching control signal corresponding to the current value added from the adding unit; and a power supply unit for controlling a driving of the compressor by applying the added current to the compressor under a dependent state on the switching control signal.

16 Claims, 8 Drawing Sheets

APPARATUS FOR CONTROLLING DRIVING OF RECIPROCATING COMPRESSOR AND METHOD THEREOF

This nonprovisional application claims priority under 35 U.S.C. § 119(a) on Patent Application No. 2002-0002060 filed in KOREA on Jan. 14, 2002, which is herein incorporated by reference.

BACKGROUND OF THE INVENTION

1. Field of the Invention

The present invention relates to a reciprocating compressor, and particularly, to an apparatus for controlling a driving of a reciprocating compressor and a method thereof.

2. Description of the Background Art

Generally, a reciprocating compressor used in a refrigerator or in an air conditioner can control a cooling capacity by varying a compression ratio of the reciprocating compressor with a voltage applied to an inner motor by a user's intention. The reciprocating compressor will be explained with reference to FIGS. 1 to 3B.

FIG. 1 is a block diagram showing a construction of an apparatus for controlling a driving of a reciprocating compressor in accordance with the conventional art.

As shown in FIG. 1, in the apparatus for controlling a driving of a reciprocating compressor, an inner stroke is varied by receiving a stroke voltage provided by an inner motor (not shown) according to a stroke reference value set by a user, and a cooling capacity is controlled by reciprocating an inner piston (not shown) up and down. The apparatus comprises a voltage detecting unit 30 for detecting a voltage applied to the reciprocating compressor 50 by a variation of the stroke; a current detecting unit 20 for detecting a current applied to the reciprocating compressor 50 by a variation of the stroke; a microcomputer 40 for calculating a stroke by using the voltage and the current detected from the voltage detecting unit 30 and the current detecting unit 20, comparing the calculated stroke with the stroke reference value, and outputting a switching control signal according to the comparison result; and a power supply unit 10 for applying the stroke voltage to the reciprocating compressor 50 by turning on/off an AC power source by using a Triac according to the switching control signal of the microcomputer 40. The stroke of the reciprocating compressor 50 is varied by a voltage applied to the motor according to the stroke reference value set by a user, thereby controlling a cooling capacity by reciprocating the piston up and down. The stroke means a distance that the piston in the reciprocating compressor 50 moves by a reciprocal movement. Hereinafter, operations for controlling a driving of a reciprocating compressor in accordance with the conventional art will be explained.

First, the triac of the power supply unit 10 lengthens a turn-on cycle by the switching control signal of the microcomputer 40, thereby increasing the stroke voltage. At this time, the voltage detecting unit 30 detects a voltage applied to the motor (not shown) in the reciprocating compressor 50, and applies the detected voltage to the microcomputer 40. At the same time, the current detecting unit 20 detects a current applied to the motor (not shown) in the reciprocating compressor 50, and applies the detected current to the microcomputer 40.

Then, the microcomputer 40 calculates a stroke by using the detected voltage and the current from the voltage detecting unit 30 and the current detecting unit 20, compares the calculated stroke with the stroke reference value, and outputs a switching control signal according to the comparison result. That is, when the calculated stroke is smaller than the stroke reference value, the microcomputer 40 lengthens the turn-on cycle of the triac and outputs the switching control signal to the power supply unit, thereby increasing the stroke voltage applied to the reciprocating compressor 50.

Meanwhile, when the calculated stroke is greater than the stroke reference value, the microcomputer 40 shortens the turn-on cycle of the triac and outputs the switching control signal to the power supply unit 10, thereby decreasing the stroke voltage applied to the reciprocating compressor 50.

In the meantime, the lower a cooling capacity is, the higher an efficiency of a refrigerating cycle of a refrigerator or an air conditioner using the reciprocating compressor is. That will be explained with reference to FIGS. 2A to 2B.

FIGS. 2A to 2B show an entire cycle efficiency of a refrigerator using the conventional reciprocating compressor, and an efficiency of the reciprocating compressor.

Referring to FIGS. 2A and 2B, as shown in "A" part, an efficiency of the conventional reciprocating compressor used in a refrigerator is lowered when the cooling capacity is varied. Also, when the efficiency of the conventional reciprocating compressor is lowered, as shown in "A-1" part, an efficiency of an entire refrigerating cycle of the refrigerator does not increase at a variable cooling capacity where the cooling capacity is varied than at a normal cooling capacity in which the cooling capacity is not varied. That will be explained with reference to FIGS. 3A and 3B.

FIG. 3A shows a waveform for a current and a displacement in a normal cooling capacity of the conventional reciprocating compressor used in a refrigerator.

As shown in FIG. 3A, the reciprocating compressor used in a refrigerator makes a top position (TP) of an inner piston reach up to a top dead center (TDC), a bottom position (BP) of the piston reach up to a bottom dead center (BDC). That is, a compression ratio of the reciprocating compressor in the normal cooling capacity of the refrigerator becomes 100%.

FIG. 3B is a waveform for a current and a displacement when the cooling capacity of the conventional reciprocating compressor used in a refrigerator is varied.

As shown in FIG. 3B, if a user decreases the cooling capacity of a refrigerator in the middle of driving the reciprocating compressor, sizes of the current and the displacement applied to the motor (not shown) in the reciprocating compressor are also decreased. At this time, the current and the displacement do not have a current offset and a displacement offset on the basis of a zero value. That is, in the conventional reciprocating compressor, the cooling capacity is decreased by just decreasing a size of the stroke (the stroke is decreased as a stroke voltage applied to the motor in the reciprocating compressor is decreased). At this time, a dead volume is increased, so that a re-expansion loss is increased, thereby lowering a compressor efficiency. The re-expansion loss means that when the piston of the compressor does not reach up to the top dead center (TDC) (when the cooling capacity is varied), gas in a cylinder of the compressor is not compressed but re-expanded, thereby having a loss. The space which is not compressed is called a "dead volume".

SUMMARY OF THE INVENTION

Therefore, an object of the present invention is to provide an apparatus for controlling a driving of a reciprocating compressor and a method thereof, in which a cooling capacity is decreased without a re-expansion loss by controlling a driving of the compressor used in a refrigerator by using a current offset when the cooling capacity of the refrigerator is varied.

Another object of the present invention is to provide an apparatus for controlling a driving of a reciprocating compressor and a method thereof, in which a compressor efficiency and an efficiency of a refrigerating cycle of a cooling apparatus are improved by controlling a driving of the compressor used in a refrigerator by using a current offset when the cooling capacity of a refrigerator is varied.

To achieve these and other advantages and in accordance with the purpose of the present invention, as embodied and broadly described herein, there is provided an apparatus for controlling a driving of a reciprocating compressor which controls a cooling capacity by varying an inner stroke according to a stroke reference value set by a user, the apparatus comprising a storage unit for storing a current offset value corresponding to a cooling capacity variable amount; an adding unit for adding the current offset value to a current value applied to the compressor in accordance with that the cooling capacity is varied by a user; a microcomputer for generating a switching control signal corresponding to the current value added from the adding unit; and a power supply unit for controlling a driving of the compressor by applying the added current to the compressor under a dependent state on the switching control signal.

To achieve these and other advantages and in accordance with the purpose of the present invention, as embodied and broadly described herein, there is provided a method for controlling a driving of a reciprocating compressor which controls a cooling capacity by varying an inner stroke according to a stroke reference value set by a user, the method comprising the steps of detecting a current offset value corresponding to a cooling capacity variable amount; adding the current offset value to a current value applied to the compressor in accordance with that the cooling capacity is varied by a user; and applying the added current to the compressor.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

An apparatus for controlling a driving of a reciprocating compressor and a method thereof will be explained with reference to FIGS. 4 to 7B, wherein when a user varies the cooling capacity of a refrigerator, the apparatus calculates the current offset value corresponding to the cooling capacity variable amount, adds the calculated current offset value to the current value applied to the compressor in a refrigerator, applies the added current to the compressor, and controls a driving of the compressor, thereby decreasing the cooling capacity of a refrigerator without a re-expansion loss. In the reciprocating compressor, a movable element moves linearly by a flux generated at the inner motor.

Figure 4:
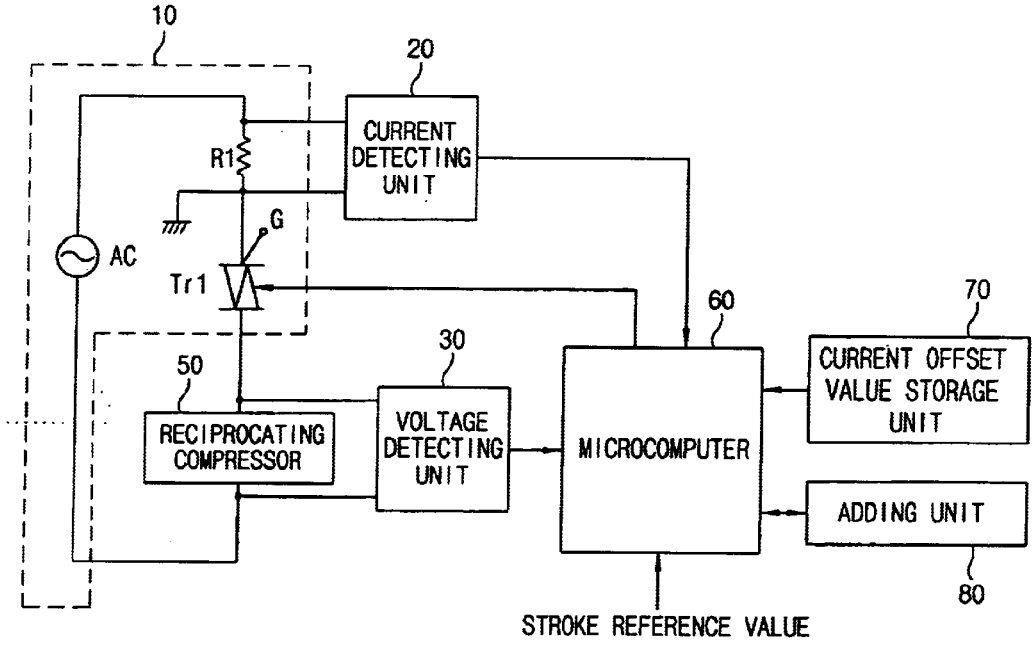
FIG. 4 shows a construction of an apparatus for controlling a driving of a reciprocating compressor according to the present invention.

FIG. 4 is a block diagram showing a construction of an apparatus for controlling a driving of a reciprocating compressor according to the present invention.

As shown in FIG. 4, the apparatus for controlling a driving of a reciprocating compressor which receives a stroke voltage provided at the inner motor (not shown) according to the stroke reference value set by a user to vary the inner stroke, and makes the inner piston (not shown) reciprocate up and down, thereby controlling the cooling capacity, the apparatus comprising a voltage detecting unit 30 for detecting a voltage applied to the reciprocating compressor 50 by a variation of the stroke; a current detecting unit 20 for detecting a current applied to the reciprocating compressor 50 by a variation of the stroke; a microcomputer 60 for calculating a stroke by using the voltage and the current detected from the voltage detecting unit 30 and the current detecting unit 20, comparing the calculated stroke with the stroke reference value, and outputting a switching control signal according to the comparison result; a power supply unit 10 for applying the stroke voltage to the reciprocating compressor 50 by turning on/off an AC power source by using the Triac according to the switching control signal of the microcomputer 60; a current offset value storage unit 70 for storing a current offset value corresponding to a cooling capacity variable amount; and an adding unit 80 for adding the current offset value to the current value applied to the compressor 50 as the cooling capacity of a refrigerator is varied by a user.

In the apparatus for controlling a driving of a reciprocating compressor according to the present invention, when the cooling capacity of a refrigerator is not varied, operations are equal to those of the conventional art, and when the cooling capacity of a refrigerator is varied by a user, the cooling capacity of a refrigerator can be decreased without a re-expansion loss by using the current offset value storage unit 70 and the adding unit 80. That is, in the apparatus for controlling a driving of the reciprocating compressor according to the present invention, when a user converts a mode of a refrigerator into a cooling capacity variable mode to vary the cooling capacity of a refrigerator, the microcomputer 60 detects the current offset value corresponding to the cooling capacity variable amount from the current offset value storage unit 70. The adding unit 80 adds the current offset value to the current value applied to the compressor 50 as the cooling capacity of a refrigerator is varied by a user. The power supply unit 10 applies the added current to the motor (not shown) of the compressor 50 by the switching control signal of the microcomputer 60, and controls a driving of the compressor 50, thereby decreasing the cooling capacity without a re-expansion loss.

Meanwhile, the stroke of the reciprocating compressor 50 is varied by a voltage and a current applied to the motor according to the stroke reference value set by a user, and the piston reciprocates up and down by the stroke, thereby controlling the cooling capacity. The stroke means a distance that the piston in the reciprocating compressor 50 moves by a reciprocal movement. That is, if the stroke of the compressor is increased (increase of a compression ratio), the cooling capacity is increased, and vice versa.

When the cooling capacity of a refrigerator is not varied, operations are equal to those of the conventional art, thereby omitting explanations. Meanwhile, with reference to FIG. 5, will be explained a method and operations for controlling a driving of a reciprocating compressor according to the present invention which decreases the cooling capacity without a re-expansion loss by using the current offset value if a user varies a mode of a refrigerator into a cooling capacity variable mode to vary the cooling capacity of a refrigerator.

Figure 5:
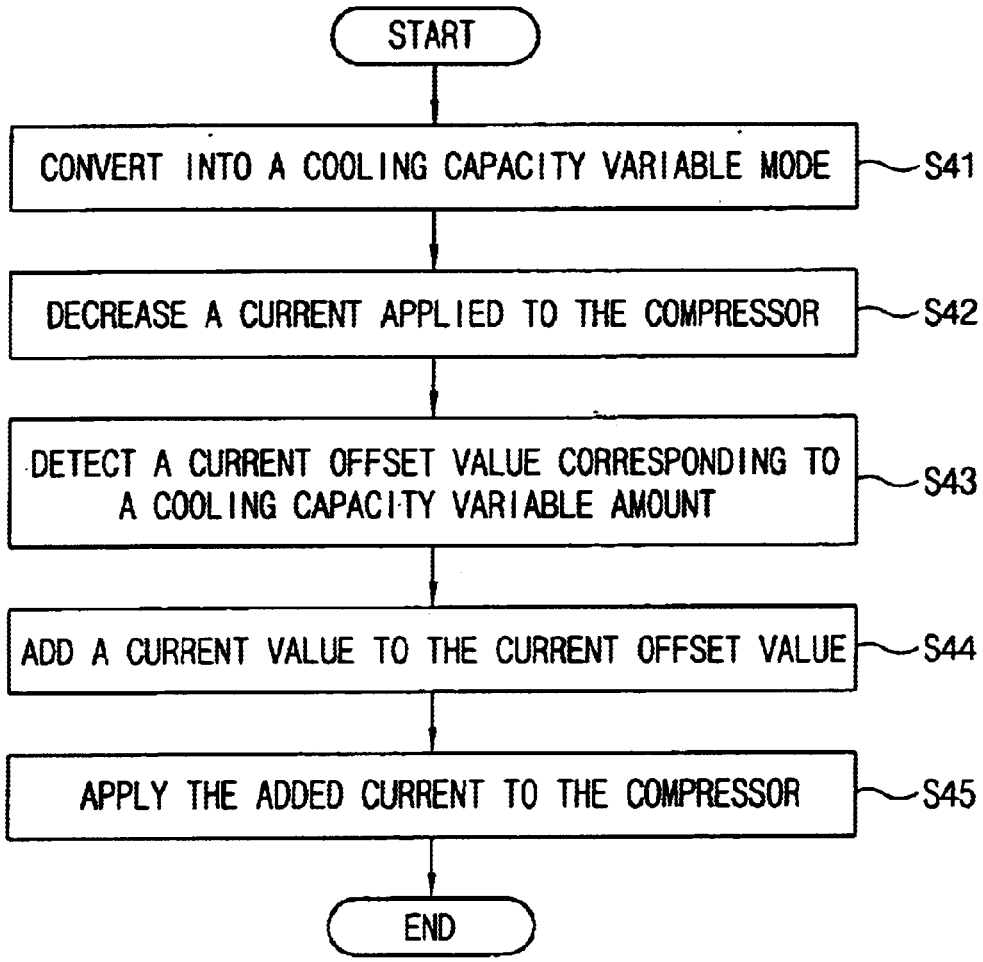
FIG. 5 is a flow chart showing a method for controlling a driving of a reciprocating compressor according to the present invention.

FIG. 5 is a flow chart showing a method for controlling a driving of a reciprocating compressor according to the present invention.

As shown in FIG. 5, the method comprises the steps of converting a mode of a refrigerator into a cooling capacity variable mode by a user (S41); decreasing a current applied to the compressor 50 as a predetermined level so as to vary the cooling capacity by a user's request (S42); detecting a current offset corresponding to a predetermined cooling capacity variable amount (S43); adding the detected current offset value to the current value decreased as the predetermined level (S44); and applying the added current to the compressor 50. The step of detecting the current offset includes the steps of detecting a displacement offset value of the stroke corresponding to the predetermined cooling capacity variable amount; previously storing the current offset value corresponding to the displacement offset value in a table in the storage unit 70; and reading the current offset value from the table and detecting.

First, when a user converts a mode of a refrigerator into the cooling capacity variable mode (S41), the microcomputer 60 decreases the current applied to the reciprocating compressor 50 as a predetermined level (S42) so as to vary the cooling capacity of a refrigerator into a user's desired temperature. That is, the microcomputer 60 outputs a switching control signal for lengthening or shortening a turn-on cycle of the triac in the power supply unit 10 to the power supply unit, thereby decreasing the current applied to the reciprocating compressor 50 as a predetermined level.

Then, the microcomputer 60 detects a displacement offset value of the stroke corresponding to the cooling capacity variable amount preset by a user. That is, the microcomputer 60 determines the displacement offset value from the cooling capacity variable amount (preset by an experience value). That will be explained with reference to FIG. 6.

Figure 6:
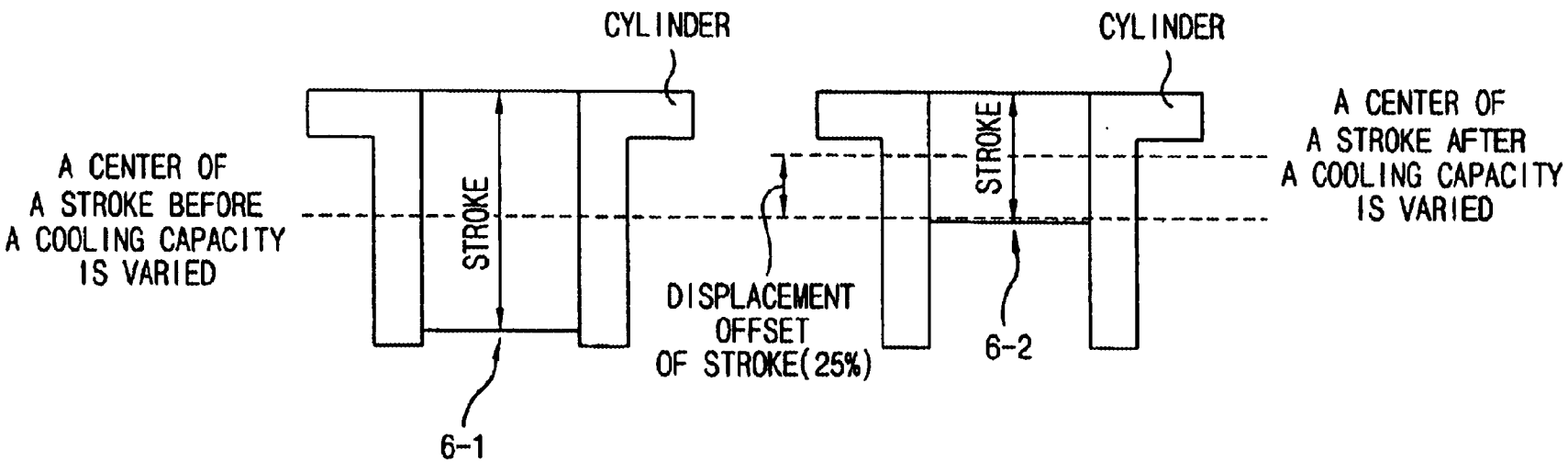
FIG. 6 shows a method for detecting a displacement offset of a stroke according to the present invention.

FIG. 6 shows a method for detecting a displacement offset of the stroke according to the present invention.

Figure 1:
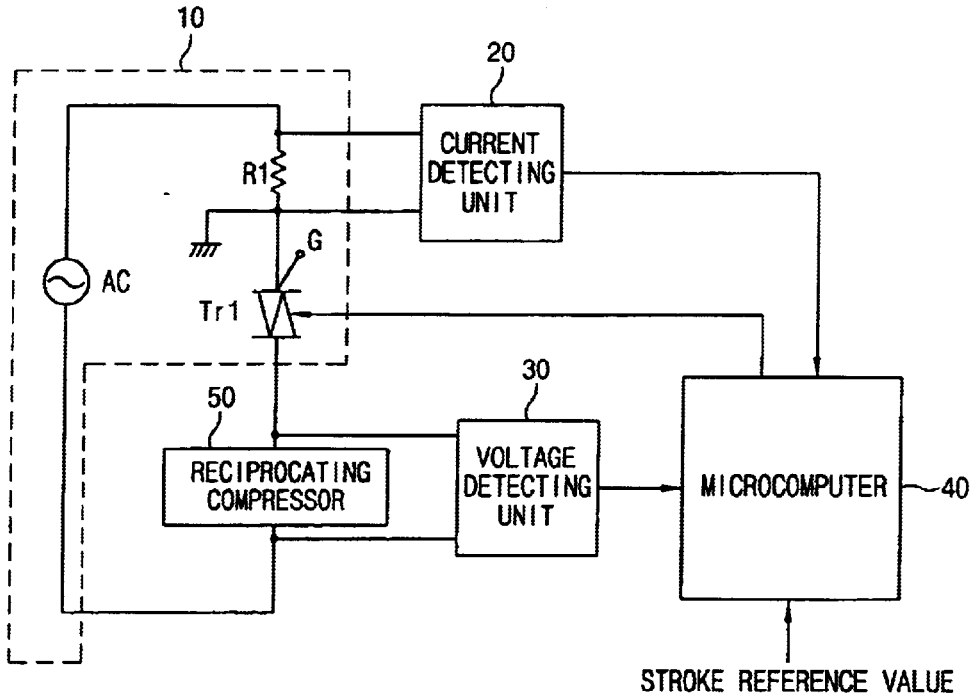
FIG.1 CONVENTIONAL ART
FIG. 1 is a block diagram showing a construction of an apparatus for controlling a driving of a reciprocating compressor in accordance with the conventional art.
Figure 2A:
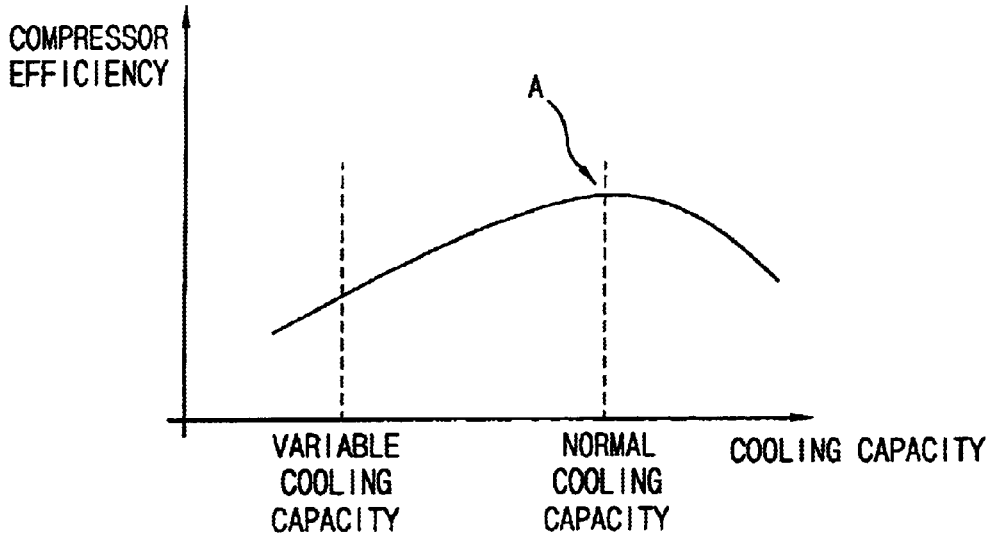
FIG.2A CONVENTIONAL ART
FIGS. 2A and 2B show an entire cycle efficiency of a refrigerator using the conventional reciprocating compressor, and an efficiency of the reciprocating compressor.
Figure 2B:
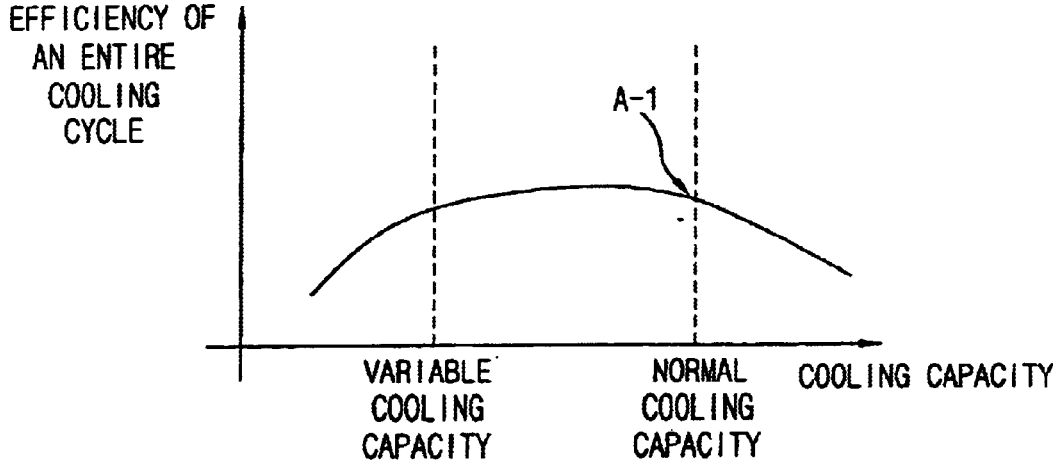
FIG.2B CONVENTIONAL ART
Figure 3A:
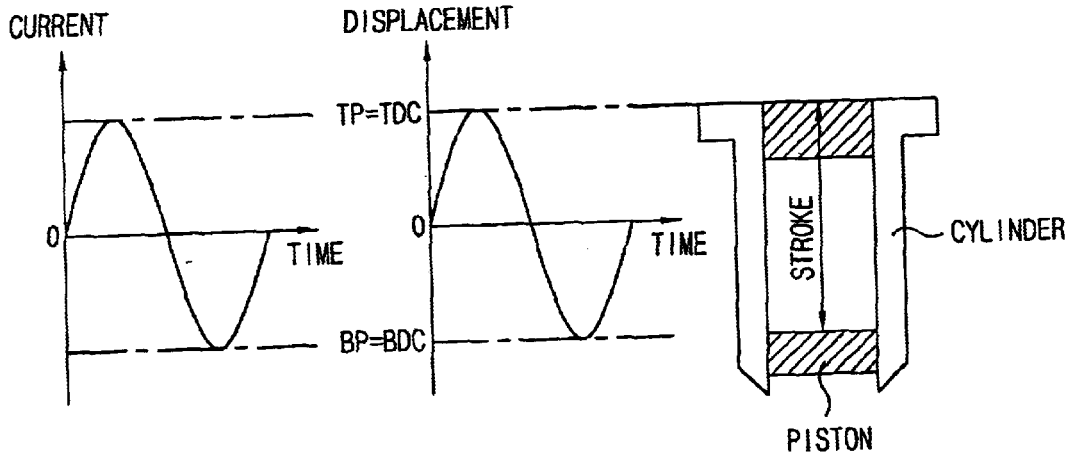
FIG.3A CONVENTIONAL ART
FIG. 3A shows a waveform for a current and a displacement in a normal cooling capacity of the conventional reciprocating compressor used in a refrigerator.
Figure 3B:
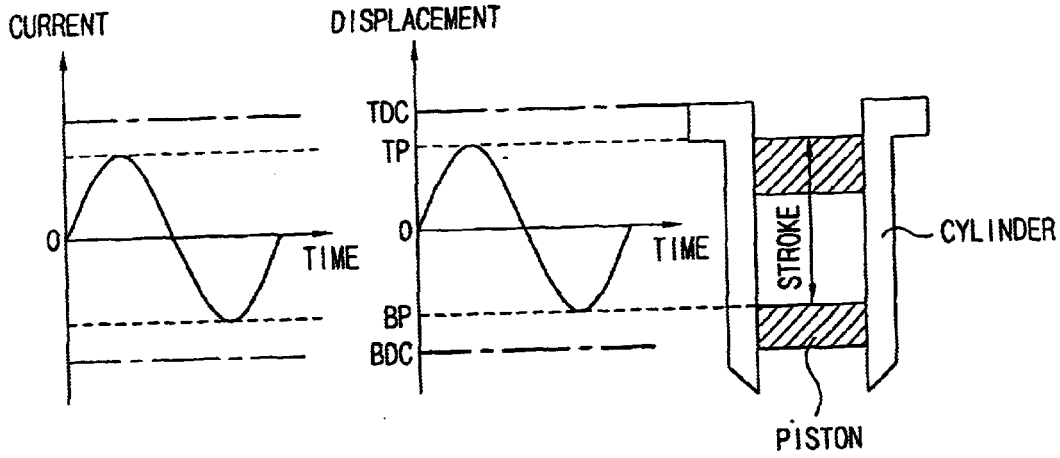
FIG.3B CONVENTIONAL ART
FIG. 3B is a waveform for a current and a displacement when a cooling capacity of the conventional reciprocating compressor used in a refrigerator is varied.

As shown in FIG. 6, when a compression ratio of the piston in the compressor is 100% (Referring to FIG. 6-1) under a state that the compressor is driven at the normal cooling capacity mode in which the cooling capacity of a refrigerator is not varied, if a user varies 50% of the cooling capacity of a refrigerator, the stroke only has to be decreased as by 50% to make a compression ratio of the piston be 50% (Referring to FIG. 6-2). That is, if the stroke is decreased as by 50%, the displacement offset becomes 25% corresponding to a half of the decreased stroke (50%), because the displacement offset is a movement amount of a center point of the stroke.

For example, when the stroke before the cooling capacity of the refrigerator is varied is 10 mm (a compression ratio of 100%), if the stroke is decreased to 5 mm (a compression ratio of 50%), the displacement offset of the stroke becomes 2.5 mm. That is, the displacement offset value of the stroke is half of the stroke variable amount. The current offset value corresponding to the displacement offset value is previously stored in the table stored in the storage unit 70. At this time, the current offset is calculated by the following equation 1.

$$\Delta i = k\frac{\Delta x}{\alpha} \qquad \text{[Equation 1]}$$

wherein, the $\Delta i$ is a current offset value, the $\alpha$ is a motor constant in the compressor [N/i] (a motor force by a motor input current), $\Delta x$ is a displacement offset value of the stroke, and k is a mechanical spring constant [N/m].

Then, the microcomputer 60 detects the current offset value corresponding to the displacement offset from the storage unit 70, detects the current value applied to the reciprocating compressor 50 from the current detecting unit 20 as the cooling capacity of a refrigerator is varied by a user, and outputs the detected current value and the current offset value to the adding unit 80.

Subsequently, the adding unit 80 adds the current offset value to the current value applied to the reciprocating compressor 50, thereby outputting the added current value to the microcomputer 60 (S44).

The microcomputer 60 outputs the switching control signal to the power supply unit 10 so that the added current from the adding unit 80 is applied to the reciprocating compressor 50. The power supply unit 10 applies the added current to the reciprocating compressor 50 by depending on the switching control signal (S45). Hereinafter, a waveform for a current and a displacement when the cooling capacity of a refrigerator is varied will be explained with reference to FIG. 7.

Figure 7:
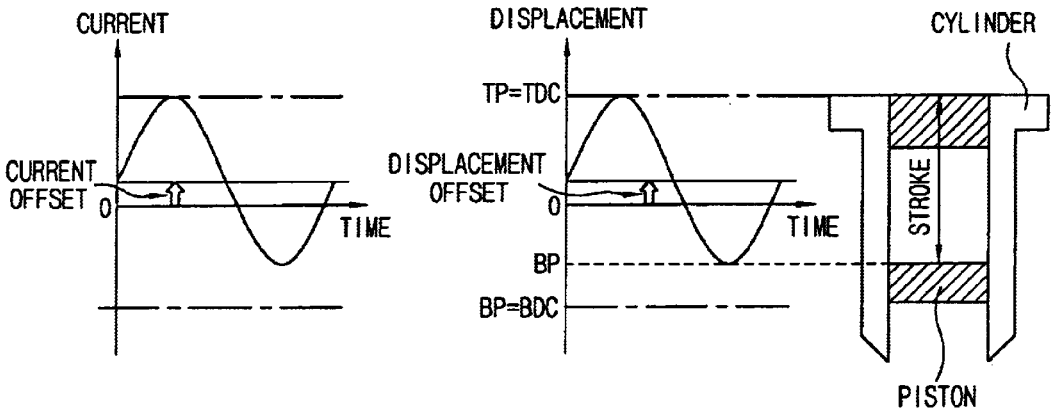
FIG. 7 shows a waveform for a current and a displacement when a cooling capacity is varied by using a reciprocating compressor used in a refrigerator according to the present invention.

FIG. 7 shows a waveform for a current and a displacement when a cooling capacity is varied by using the reciprocating compressor used in a refrigerator according to the present invention.

As shown in FIG. 7, if the added current is applied to the reciprocating compressor 50, a top position (TP) of the piston reaches up to a TDC, and a bottom position (BP) of the piston does not reach up to a bottom dead center (BDC), so that the TP of the piston is maintained as the TDC and the cooling capacity is decreased. At this time, since the TP of the piston is located at the TDC, a dead volume is not decreased, thereby not increasing a re-expansion loss. According to this, a compressor efficiency and an entire refrigerating cycle efficiency of a refrigerator do not decrease even if the cooling capacity is varied as shown in FIGS. 8A and 8B.

Figure 8A:
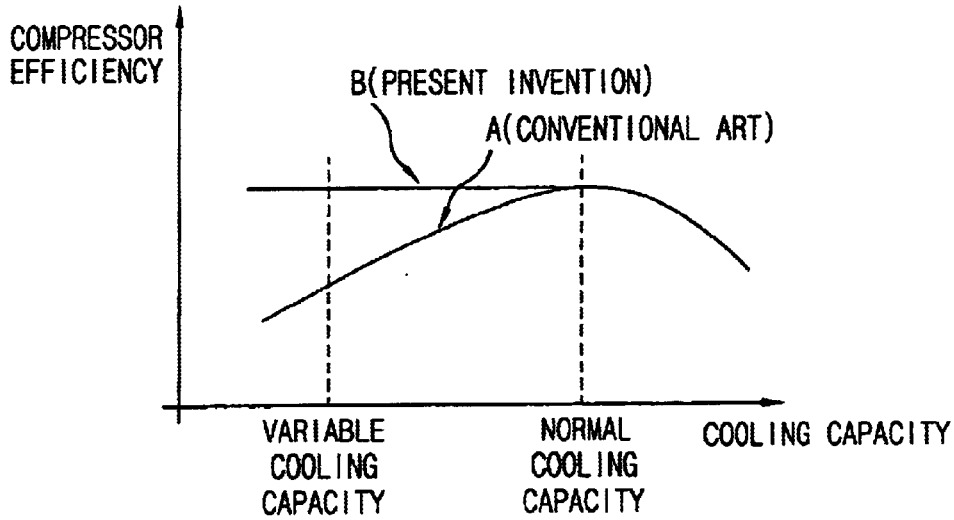
FIGS. 8A and 8B show a comparison of an entire refrigerating cycle efficiency of a refrigerator using the conventional reciprocating compressor and an efficiency of the conventional reciprocating compressor with those according to the present invention.
Figure 8B:
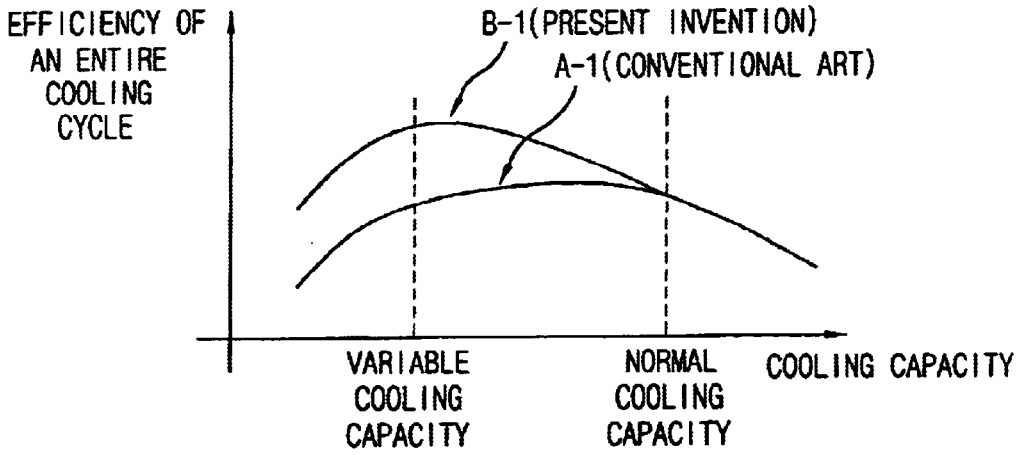

FIGS. 8A and 8B show a comparison of an entire refrigerating cycle efficiency of a refrigerator using the conventional reciprocating compressor and an efficiency of the conventional reciprocating compressor with those according to the present invention.

As shown in FIGS. 8A and 8B, an efficiency of the conventional reciprocating compressor is lowered when the cooling capacity is varied as shown in "A" part. That is, when the efficiency of the conventional reciprocating compressor is lowered like "A", as shown in "A-1" part, an efficiency of an entire refrigerating cycle of the refrigerator does not increase at the cooling capacity variable mode for varying the cooling capacity than at the normal cooling capacity in which a cooling capacity is not varied.

Meanwhile, in the present invention, by adding the current offset value to the current value applied to the compressor in accordance with that the cooling capacity is varied, and by applying the added current value to the compressor, a compressor efficiency at the variable cooling capacity mode is equal to that at the normal cooling capacity mode even if the cooling capacity is varied as shown in "B" part. Therefore, an entire refrigerating cycle efficiency of a refrigerator is increased as shown in "B-1" part when the cooling capacity is varied.

In the meantime, the reciprocating compressor used in the refrigerator is just a preferred embodiment to explain the reciprocating compressor according to the present invention, and the reciprocating compressor according to the present invention can be used not only in a refrigerator but also in a cooling apparatus such as an air conditioner.

As aforementioned, in the present invention, when the cooling capacity is varied by the reciprocating compressor used in a refrigerator, the current value applied to the compressor is added to the current offset value in accordance with that the cooling capacity is varied, and the added current is provided to the compressor to control a driving of the compressor, thereby decreasing the cooling capacity without a re-expansion loss and improving an entire refrigerating cycle efficiency of a refrigerator.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling a driving of a reciprocating compressor, the reciprocating compressor controlling a cooling capacity by varying an inner stroke according to a stroke reference value set by a user, the apparatus comprising:

a storage unit for storing a current offset value corresponding to a cooling capacity variable amount;

an adding unit for adding the current offset value to a current value applied to the compressor in accordance with the cooling capacity varied by a user;

a microcomputer for generating a switching control signal corresponding to the current value added from the adding unit; and a power supply unit for controlling driving of the compressor by applying the added current to the compressor based on the switching control signal.

2. The apparatus of claim 1, wherein the microcomputer detects the current offset value corresponding to the cooling capacity variable amount from the storage unit if a user converts a mode of a refrigerator into a cooling capacity variable mode so as to vary the cooling capacity of a refrigerator, thereby generating the switching control signal.

3. The apparatus of claim 1, wherein the current offset value is calculated by an equation of $$\Delta i = k\frac{\Delta x}{\alpha},$$

wherein the Δi is a current offset value, the α is a motor constant in the compressor (a motor force by a motor input current), Δx is a displacement offset value of the stroke, and k is a mechanical spring constant.

4. The apparatus of claim 3, wherein the displacement offset value is a movement amount of a center point of the stroke, and a half of the variable amount of the stroke.

5. The apparatus of claim 1, wherein the current offset value is calculated by an equation of $$\Delta i = k\frac{\Delta x}{\alpha}$$

and previously stored in the storage unit, wherein the Δi is a current offset value, the α is a motor constant in the compressor (a motor force by a motor input current), Δx is a displacement offset value of the stroke, k is a mechanical spring constant, and the displacement offset value of the stroke is preset and stored in the storage unit on the basis of the cooling capacity variable amount.

6. The apparatus of claim 1, wherein a movable element moves linearly by a flux generated at the motor in the reciprocating compressor.

7. The apparatus of claim 1, further comprising a detector for detecting a displacement offset value of the stroke, wherein said storage unit stores the current offset value according to the displacement offset value detected by the detector.

8. The apparatus of claim 1, wherein said power supply unit controls the stroke such that the top dead center position remains the same while the cooling capacity is varied by the user.

9. A method for controlling driving of a reciprocating compressor, the reciprocating compressor controlling a cooling capacity by varying an inner stroke according to a stroke reference value set by a user, the method comprising the steps of:

detecting a current offset value corresponding to a cooling capacity variable amount;

adding the current offset value to a current value applied to the compressor in accordance with the cooling capacity varied by a user; and applying the added current to the compressor.

10. The method of claim 9, where in the cooling capacity variable amount is determined by a user's request.

11. The method of claim 9, wherein the current offset value is calculated by an equation of $$\Delta i = k\frac{\Delta x}{\alpha},$$

wherein the Δi is a current offset value, the α is a motor constant in the compressor, Δx is a displacement offset value of the stroke, and k is a mechanical spring constant.

12. The method of claim 11, wherein the displacement offset value is a movement amount of a center point of the stroke, and a half of the varied stroke.

13. The method of claim 9, wherein the current offset value is calculated by an equation of $$\Delta i = k\frac{\Delta x}{\alpha}$$

and previously stored in the storage unit, wherein the Δi is a current offset value, the α is a motor constant in the compressor, Δx is a displacement offset value of the stroke, k is a mechanical spring constant, and the displacement offset value of the stroke is preset and stored in the storage unit on the basis of the cooling capacity variable amount.

14. The method of claim 9, wherein said step of detecting further comprises the steps of detecting a displacement offset value of the stroke corresponding to the cooling capacity variable amount and storing the current offset value corresponding to the displacement offset value.

15. The method of claim 9, further comprising the step of generating a switching control signal corresponding to the current value added in said adding step, said step of applying further comprising applying the added current based on the switching control signal.

16. The method of claim 15, further comprising the step of controlling the driving of the compressor such that the top dead center position remains the same while the cooling capacity is varied by the user.

* * * * *